United States Patent [19]

Ehnert et al.

[11] Patent Number: 4,886,701

[45] Date of Patent: Dec. 12, 1989

[54] PROCESS FOR PRODUCING A TANGLED FIBRE MATERIAL FROM GLASS FIBRES AND POLYMER FOR THE PRODUCTION OF GLASS FIBRE-REINFORCED PLASTIC MOULDINGS AND APPARATUS FOR PERFORMING THE PROCESS

[75] Inventors: Gerd Ehnert, Graben-Neudorf; Manfred Ehlers, Kraichtal-Unteröswisheim; Gerhard Sauer, Bruchsal; Klaus Vogel, Kraichtal-Menzingen, all of Fed. Rep. of Germany

[73] Assignee: Menzolit GmbH, Kraichtal-Menzingen, Fed. Rep. of Germany

[21] Appl. No.: 88,423

[22] Filed: Aug. 24, 1987

[30] Foreign Application Priority Data

Sep. 1, 1986 [DE] Fed. Rep. of Germany ..... 3629748
Feb. 10, 1987 [DE] Fed. Rep. of Germany ..... 3704035

[51] Int. Cl.[4] ..... B32B 17/04; B29C 67/14

[52] U.S. Cl. ..... 428/282; 156/62.2; 156/62.4; 156/62.6; 264/115; 264/116; 264/117; 264/136; 264/143; 264/517; 264/DIG. 51; 427/185; 427/195; 427/213; 427/296; 428/280; 428/284; 428/288

[58] Field of Search ..... 264/115, 143, 517, 136, 264/DIG. 51, 117, 116; 427/213, 296, 195, 185; 156/62.6, 62.4, 62.2; 428/280, 282, 284, 288

[56] References Cited

U.S. PATENT DOCUMENTS

| | | | |
|---|---|---|---|
| 2,863,493 | 12/1958 | Snow et al. | 156/62.6 X |
| 2,897,874 | 8/1959 | Stalego et al. | 156/62.6 X |
| 3,567,485 | 3/1971 | Lemelson | 427/185 |
| 3,589,956 | 6/1971 | Kranz et al. | 156/62.4 X |
| 3,669,638 | 6/1972 | Wong et al. | 264/115 |
| 3,742,106 | 6/1973 | Price | 427/185 X |
| 3,939,532 | 2/1976 | Wiegand | 264/115 X |
| 4,147,574 | 4/1979 | Setsuie et al. | 156/62.4 |
| 4,164,534 | 8/1979 | Ogino | 264/115 X |
| 4,172,174 | 10/1979 | Takagi | 156/62.4 X |
| 4,363,680 | 12/1982 | Buck, Jr. et al. | 427/195 X |
| 4,421,669 | 12/1983 | Brichard | 427/213 X |
| 4,457,793 | 7/1984 | Buck, Jr. | 156/62.6 |
| 4,614,678 | 9/1986 | Ganga | 264/136 X |

*Primary Examiner*—Philip Anderson
*Attorney, Agent, or Firm*—Antonelli, Terry & Wands

[57] ABSTRACT

A tangled fibrous material from cut glass fibre bundles, with the cut glass fiber bundler being fed into a compressed air flow and a glass fibre-laden air being deflected into a turbulent eddy flow of varying direction, so that a tangled fibrous material of wadding-like consistency is formed. Through the simultaneous addition of dry polymer-based binder powder, it is possible to obtain a tangled fibrous material as a starting product for a production of glass fibre-reinforced plastic moundings, which can be compressed to a felt. This can be packed as an intermediate or further processed in a heated belt press to glass fibre-reinforced plastic plates.

46 Claims, 5 Drawing Sheets

PROCESS FOR PRODUCING A TANGLED FIBRE MATERIAL FROM GLASS FIBRES AND POLYMER FOR THE PRODUCTION OF GLASS FIBRE-REINFORCED PLASTIC MOULDINGS AND APPARATUS FOR PERFORMING THE PROCESS

BACKGROUND OF THE INVENTION

The invention relates to a process for producing a tangled fibre material from cut glass fibre bundles and a polymer-based binder as the starting product for the production of glass fibre-reinforced plastic mouldings and to an apparatus for performing this process.

The invention mainly relates to the processing of cut glass fibres, but can be used in the same way in connection with other inorganic fibres or synthetic organic fibres, such as carbon fibres, aramide fibres or polyester fibres. To the extent that reference is made to glass fibres, they can also be replaced by the aforementioned fibres acting in the same way.

Cut glass fibres are processed to a considerable extent for glass fibre-reinforced plastic mouldings. Problems occur when processing the glass fibres to a tangled fibrous material, because the glass fibres at least compared with organic fibres are comparatively flexurally rigid. In addition, the glass fibres are cut to length from multifilament fibre strands, so that glass fibre bundles are obtained, within which the individual glass fibres are parallel and closely juxtaposed. It is difficult to process the glass fibre bundles to tangled individual fibres. In practice, tangled fibre material formation takes place either by spreading out the fibres to form a fleece and impregnating the latter with a liquid synthetic resin, or the fibres are processed in liquid phase to a suspension, which is processed by a stirring or mixing movement to give a tangled fibre material. Here again, either liquid synthetic resins, or pulverulent binders are used in conjunction with an aqueous suspension. In the latter case, the suspension is dried after forming a tangled fibre fleece.

It has also been proposed (P 36 04 888.7) to add wetting agents in a proportion of max 20% by weight, so as to obtain a moist, but still free flowing material, which can be packed as an intermediate in plastic bags and so supplied to further processors or it can be processed in a heated belt press to preshaped plate or sheet material. The desired glass fibre-reinforced plastic mouldings can be produced from these intermediates.

The aim underlying the present invention results in providing a process and an apparatus for the production of tangled fibre materials from cut glass fibre bundles as a starting product for the production of glass fibre-reinforced mouldings, which operate on a dry basis.

According to the invention, the glass fibre bundles are vortexed and filamented in a turbulent air flow and the binder is added in powder form at least during vortexing.

Practical tests have revealed that the otherwise markedly direction-oriented and adhering glass fibre bundles can be opened up, i.e. filamented to a tangled fibrous material using the inventive compressed air process, in which the short single fibres are completely individualized and assume a completely irregular arrangement and distribution. It is possible in this way to produce from the cut glass fibre bundles, a voluminous wadding-like fibrous material, which is characterized by a maximum disorientation of the individual glass fibres.

In connection with the aforementioned production of the tangled fibre or fibrous material, the plastic binder is simultaneously added in powder form, because during the opening up of the glass fibres by whirling or vortexing in the compressed air flow and simultaneous introduction of the binder powder, an excellent, homogeneous mixture is obtained, in which the binder grains adhere to the glass fibres or are held in homogeneous distribution in the wadding or cottonwool-like tangled fibrous material. Advantageously the binder is fed into the air flow together with the glass fibres. During vortexing, due to the different structure of the glass fibres and the binder, (fibres or powder granules) they are accelerated differently and in this way the binder particles are virtually shot into the glass fibres. A completely homogeneous thorough mixing is not achieved if there is initially a vortexing of the fibres, followed by the addition of the binder and then an attempt is made to bring about mixing. Such a mixing would at the best merely be of a local nature.

As a result of the inventive procedure there is firstly a mechanical anchoring of the binder between the glass fibres, so that the binder granules or powder particles are surrounded by glass fibres and are secured between them. The mechanical anchoring can also be improved in that the pulverulent binder is supplied with an angular and rough surface configuration. According to a preferred embodiment, during vortexing, the components are electrostatically charged, which brings about an electrostatic adhesion of the components.

Advantageously the formulation of the binder powder falls within the following ranges: Thermoplastic powder 50 to 90% by weight, carbon black 0 to 15% by weight, antioxidants 0 to 5% by weight and miscellaneous, such as mineral fillers, particularly chalk, talc or the like 0 to 30% by weight.

The tangled fibrous material obtained in accordance with the invention which, as stated, has a cottonwool-like consistency, is preferably compressed to a felt-like structure. In this form, the tangled fibrous material can be handled for further processing purposes, e.g. it can be packed into film or sheet bags and transferred to the processor, or it can be immediately further processed after fleece production and using pressure and heat to a sheet or plate material to serve as an intermediate. Compression can in particular be brought about in that the packing of the tangled fibrous material takes place in bags under vacuum. To the extent that the binder has been vortexed with the fibres, this largely eliminates a phase separation of the fibres and binders during storage and transportation.

An apparatus for performing the process is initially characterized by a vortex chamber with venting and a compressed air line feeding into the same, as well as at least one feeding device for the glass fibre bundles and binder powder.

The glass fibres are fed by a feeding mechanism into the compressed air line and are entrained by the compressed air flow. The latter is given a strong, turbulent eddy flow in the following vortex chamber, the glass fibres being individualized and brought into a loose tangled form. Alternatively, the glass fibres can be fed directly into the vortex chamber.

Preferably, the apparatus is also characterized by at least one feeding mechanism for the binder powder, so that within the vortex chamber and in a single operation, not only are the glass fibres opened up to form a tangled fibrous material, but simultaneously mixing with the dry binder takes place.

According to a further advantageous development of the inventive apparatus, the compressed air line has a mouthpiece issuing into the vortex chamber and which is movable in varying direction with respect to the vortex chamber. The mouthpiece can, for example, be moved at right angles to the flow axis in an oscillatory movement or in a movement rotating about the flow axis, so that, within the vortex chamber, there is a constantly varying eddy flow. This permits a particularly effective and rapid production of the tangled fibre material.

According to a further development of the invention, the vortex chamber is constructed as a container with a discharge opening extending over the container cross-section and in that a discharge gate is provided which is introduced into the container from the side opposite to the discharge opening and which can be moved up to the latter. By the discharge gate, the tangled fibrous material collecting in the container can be discharged in simple manner.

According to a further feature of the inventive apparatus, a compression mechanism is connected to the discharge opening in order to produce the precompressed felt from the tangled fibrous material. This compression mechanism can advantageously be formed by the discharge gate and a counter pressure plate spaced from the discharge opening. Thus, the tangled fibrous material is preshaped to a felt immediately following discharge from the vortex chamber.

It is possible to connect to the compression mechanism either a heated belt press for further processing of the compressed glass fibre belt to glass fibre-reinforced plastic plates as an intermediate for the production of mouldings, or a device for packing the glass fibre felt in film packs. In the first case, handleable glass fibre-reinforced plastic plates are produced as an intermediate, which can be fed into a heated moulding press immediately following their production, or can be supplied to a further processor. In the second case, the felt can be packed in the form given to it. The packaging film is preferably made from the same material as the matrix (thermoplastic) of the felt, or from a material compatible therewith, so that it can be concomitantly processed during moulding production.

During the further processing of the inventively produced tangled fibre material to glass fibre-reinforced plastic mouldings, it has been found that compared with products produced in a conventional manner, there is an increase both in the modulus of elasticity and in the bending strength. The reason for this is doubtless the much better opening up of the glass fibre bundles and the more homogeneous mixing with the dry binder. In particular, it is possible to process higher-grade, so-called technical thermoplastics with a better thermal stability than the hitherto regularly used polypropylene. In particular, in the case of the process according to the invention, the individual components can be rapidly changed in small batches or charges, or the quantity thereof can be modified, so that the matrix (thermoplastic) and reinforcement type can at any time be adapted in optimum manner to the particular requirements for mouldings, e.g. on changing the moulds for producing the mouldings. The inventive process offers the possibility in connection with the production of glass fibre-reinforced products of reduced capital expenditure and energy costs, particularly as a single vortex chamber can be positioned downstream of several different moulds.

An important advantage of the felt or cottonwool-like intermediate produced by the inventive process is that through the tangled form of the individual fibres and not only the bundles, as in the prior art, there is a better flowability of the heated product during further processing.

The invention also provides a product for the production of fibre-reinforced thermoplastic parts, which is characterized by a cottonwool-like felt, in which the individual fibres are virtually completely individualized and assume an irregular arrangement and distribution. In the case of a plate or sheet-like semifinished product for the production of fibre reinforced thermoplastic parts, as well as a fibre-reinforced thermoplastic moulding, the individual fibres are virtually completely individualized and assume an irregular arrangement and distribution.

Following on to the inventive process stages, the semifinished product and moulding can fundamentally be further produced in known manner.

The invention is described in greater detail hereinafter relative to non-limitative embodiments and the attached drawings.

DETAILED DESCRIPTION

Figure 1:
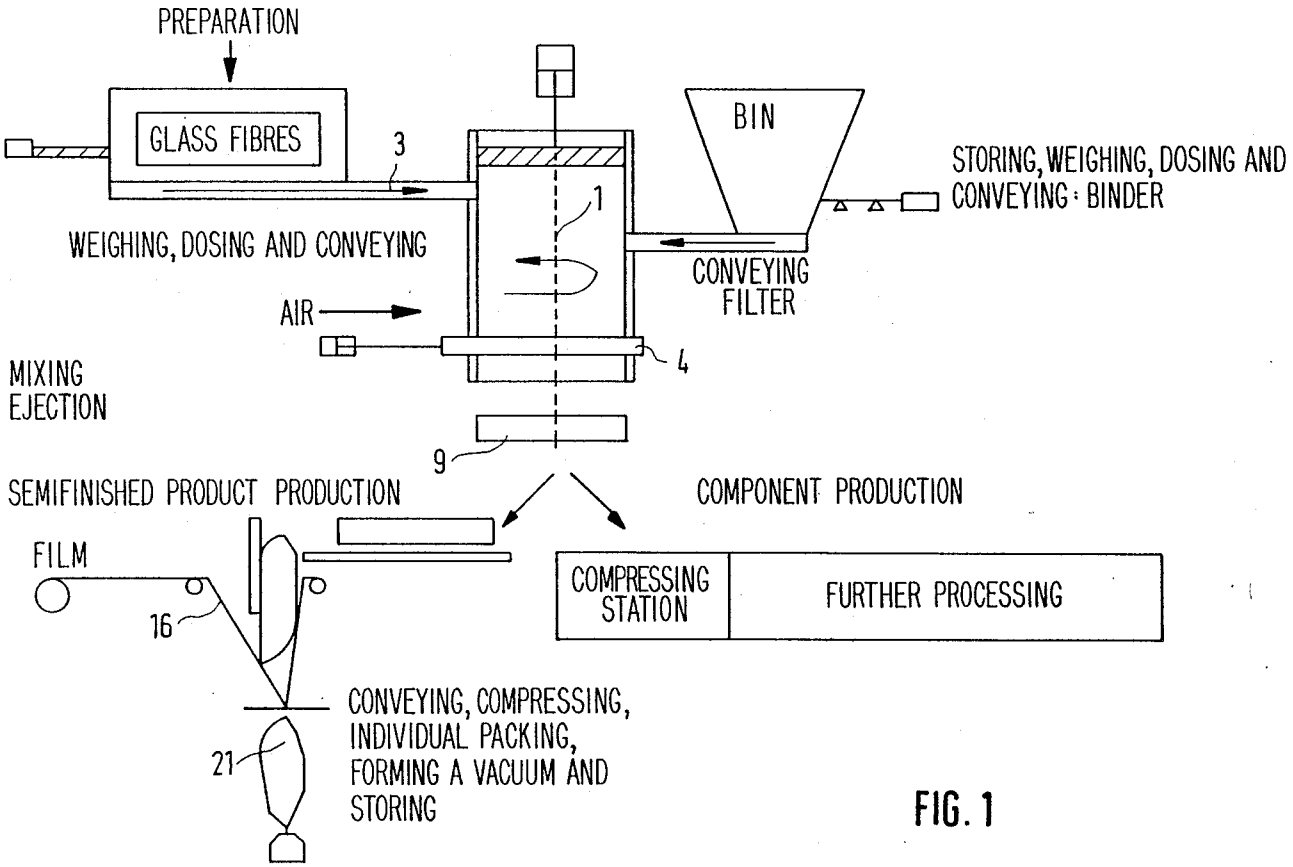
FIG. 1 is a diagram of a preferred process sequence.

FIG. 1 is a flow chart of a preferred realization of the inventive process. Use is made of glass fibres, which are prepared and supplied by a feeding mechanism. In place of glass fibres, it is also possible to use carbon, aramide, polyester or similar fibres. The binder is also made ready. It has a thermoplastic, such as polypropylene as the matrix. It must merely be borne in mind that the thermoplastic must be supplied as a powder and, preferably in the form of a coarse powder, so that a granular material may have to be made finer by a mill. The binder can also contain carbon black, wax or other additives. The individual components are mixed together in conventional manner in a heating/cooling mixer and placed in a bin or bunker. The individual components, namely, glass fibres and binders are dosed and supplied to the vortex chamber 1, into which compressed air is blown for vortexing or whirling. As no high pressure is built up in vortex chamber 1 and instead only the individual components are vortexed, its walls are made from a filter material, through which the blown in air can pass, but which holds back the material components.

Glass fibres, binder and air are separately supplied to the vortex chamber 1. Instead glass fibres and binders can be jointly dosed into a feed hopper and are then jointly supplied to the vortex chamber. They are not supplied directly to the vortex chamber and, in fact, this takes place by a compressed air line, which leads to the vortex chamber 1, as will be explained in greater detail hereinafter.

Following an adequate vortexing of the components in vortex chamber 1, a discharge opening is opened by gate 4 and the vortexed material is ejected from the vortex chamber 1 as "cotton plug" or felt 9. For producing semifinished products, the latter is guided between foils or films 16 and is packed by the latter under vacuum in continuously linked bags 21. The dosed felt 9 packed in this way can be stored and transported, without there being any fear of a disadvantageous separation of the individual components.

Alternatively, this can immediately be followed by finished product or component production. For this purpose the felt 9 is supplied to a compressing station and then further processed, namely, melted in an appropriate way, followed by optional dosing, supplied to a press, where compression to a moulding takes place in per se known manner.

While the parameters of the supplied glass fibre bundles can be varied within a considerable range, as a function of the desired characteristics of the finished product, such as modulus of elasticity and bending strength, preferably, fibre bundles with a length of 4 to 25 mm and a texturing of 5.5 to 300 tex are used. The fibre bundles can comprise 200 to 800 individual filaments with individual fibre diameters of 5 to 20 and preferably 8 to 14 μm.

Good vortexing and therefore the possibility to form tangled layers is in particular revealed by the fact that on supplying glass fibres in the aforementioned range with a bulk density of 600 to 800 g/liter and binder with a bulk density of 500 g/liter, the "wadding product" formed after vortexing and prior to compression has a density of 20 g/liter. The air blown into the vortex chamber can be supplied with a pressure variable within wide limits, but said pressure should not be below 0.5 bar, because then adequate vortexing can no longer be achieved. On the one hand mixing is improved with higher pressure and on the other hand equally good mixing can be achieved at higher pressure in a shorter time. Therefore preference is given to a pressure of 7 to 10 bar, good mixing being obtained in the case of the aforementioned bulk density and in the case of the aforementioned starting components at 7 bar and 10 to 15 seconds.

Figure 2:
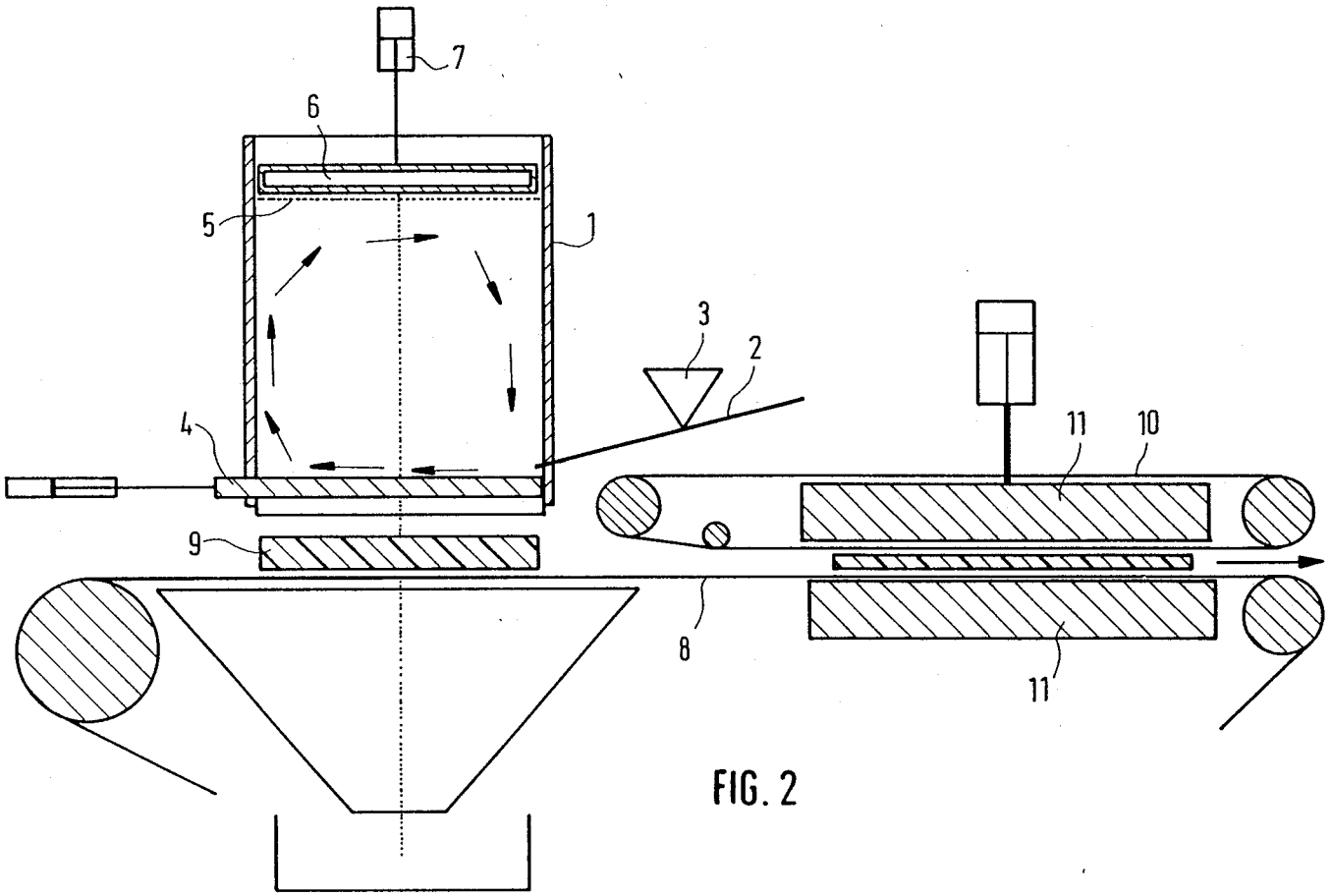
FIG. 2 is a diagrammatic view of the apparatus according to a first embodiment.

The apparatus shown in FIG. 2 has as its basic part a container-like vortex chamber 1, into which a compressed air line 2 issues close to the bottom. The compressed air line 2 is provided with a feeding mechanism, e.g. in the form of a feed hopper 3, into which is fed a glass fibre quantity matched to the vortex chamber size and a correspondingly dosed binder powder quantity. Glass fibres and binders are e.g. entrained by injector action by the compressed air flow in line 2. The bottom of vortex chamber 1 is formed by a gate 4, which in the indicated position seals the container at the bottom and in the not shown open position frees the entire container cross-section. On its top surface container 1 is provided with a vent, which is e.g. formed by a filter 5. Behind the filter is provided a discharge gate 6, which roughly fills the cross-section of container 1 and is driven by means of a lifting cylinder 7.

The binder powder and the glass fibres fed into the feed mechanism 3 flow at high speed into container 1 and are deflected there into an irregular eddy flow, as indicated by the arrows. Over a period of time a tangled fibrous material forms within the container 1 from the opened up glass fibre bundles and this is simultaneously homogeneously mixed with the binder powder.

In the embodiment according to FIG. 2, a conveyor belt 8 runs below the container 1 and, immediately below container 1 and the conveyor belt 8, is positioned a counter pressure plate (not shown) which, together with the discharge gate 6, forms a compression mechanism. After opening the gate 4 and freeing the discharge opening, the discharge gate 6 moves downwards and moves the voluminous tangled fibrous material in front of it and compresses it against the counter pressure plate located below the conveyor belt 8 to form a felt 9. The felt 9 is supplied, in a fixed-cycle operation, to a belt press 10, which is provided with upper and lower heating devices 11, so that the felt 9 is compressed to a glass fibre-reinforced plastic plate as an intermediate.

Figure 3:
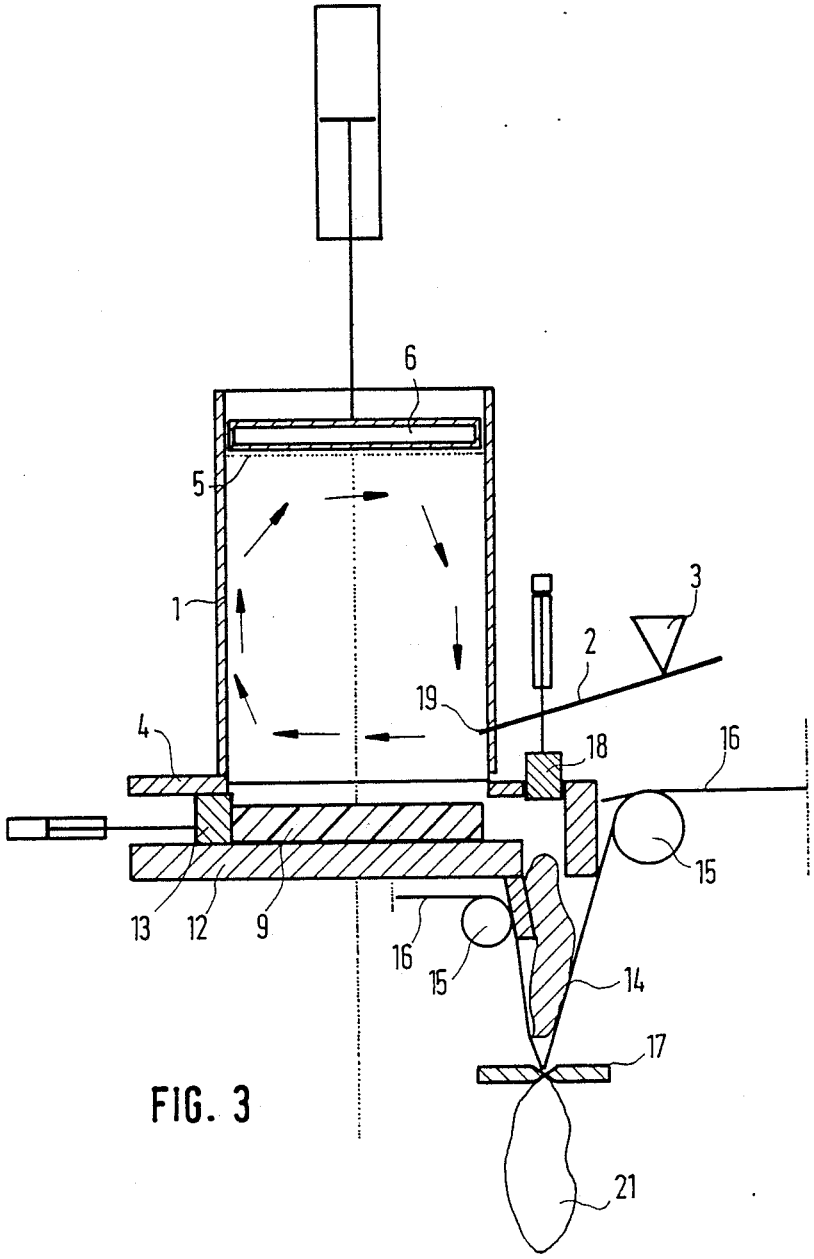
FIG. 3 is a diagrammatic view of a second embodiment of the apparatus.

In the embodiment according to FIG. 3, it is possible to see the counter pressure plate 12 forming part of the compression mechanism. Otherwise the vortex chamber 1 and the components associated therewith essentially correspond to the embodiment of FIG. 1. As a modification compared with this apparatus a conveying slide 13 runs above the counter pressure plate 12 and downwardly conveys the precompressed felt from the plate 12. Behind the counter pressure plate 12 is arranged a packing mechanism 14, which has two feed rolls 15 for in each case one film 16, as well as a welding device 17 and a packing cylinder 18. The felt 9, moved from the counter pressure plate 12 by the slide 13, is tamped by the packing cylinders 18 between the two films 16 and, subsequently, the film is cyclically conveyed on, the welding device 17 enclosing between the films the resulting tangled fibrous material portions.

In order to make the vortexing of the glass fibres within the vortex chamber 1 particularly effective, the compressed air line 2 can have a mouthpiece 19 projecting into the vortex chamber 1 and whose direction is variable by the movement of the mouthpiece 19, which ensures that a constant vortex is not formed within vortex chamber 1.

Figure 4:
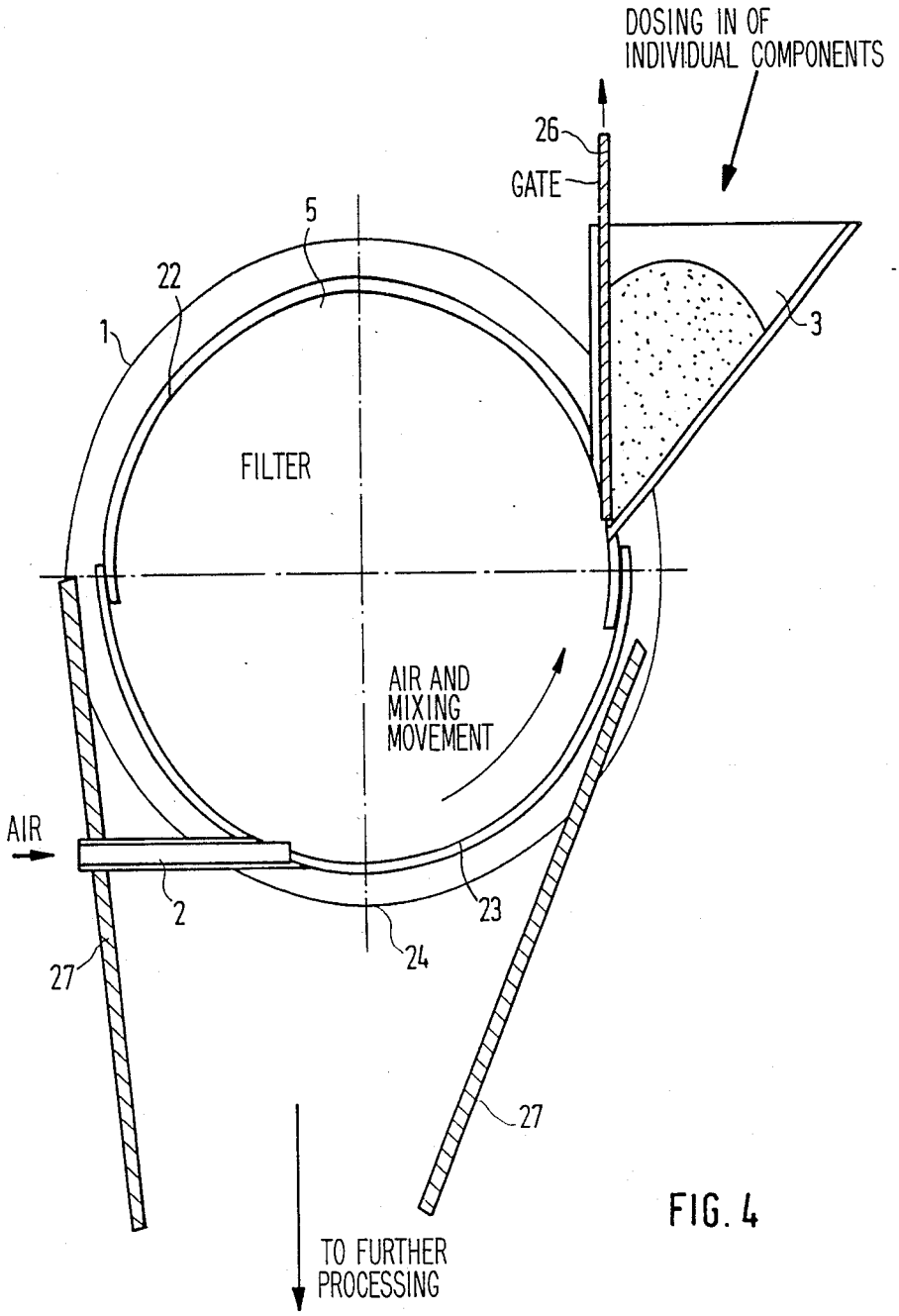
FIG. 4 in a diagrammatic representation of a further embodiment of the inventive apparatus.

FIG. 4 shows an alternative construction of vortex chamber 1, which is constructed as a horizontal cylinder covered on its end faces by filter 5. The upper cylinder jacket half 22 is fixed and impermeable. The lower cylinder half 23 is constructed as a closure slide, which can be moved along the jacket 22, so as to free a discharge opening 24. Laterally and at roughly half the height of vortex chamber 1 is provided the feed hopper 3, into which are dosed the individual components in particular, the glass fibres and binder. The feed hopper 3 is closed a slide 26 towards vortex chamber 1 and the slide 26 can be opened for feeding material into the vortex chamber 1. In the vicinity of the bottom point of the vortex chamber 1, the compressed air line 2 passes roughly tangentially to the cylinder jacket circumference into vortex chamber 1, the air flowing in the opposite direction to the pouring direction of the material from feed hopper 3. Discharge opening 24 is bounded by a chute, which is formed by metal deflectors 27 directed towards one another. The material which falls from vortex chamber 1 through chute 27 through opening gate 23 can then, in the manner described above, be filled into film bags or compacted, optionally in a manner different from that described above, followed by subsequent further processing.

Figure 5:
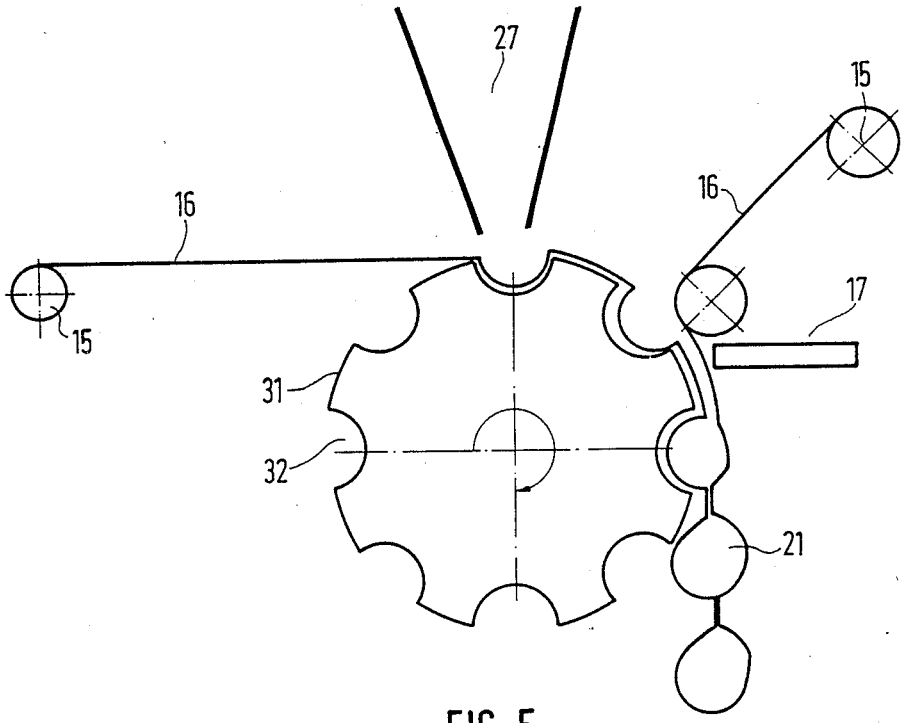
FIG. 5 in a packaging device for packaging tangled fibrous material modified compared with the construction of FIG. 2.

In particular the tangled fibrous material can be packed in a manner different from that described relative to FIG. 3 and this is illustrated in FIG. 5. Packing device 14 of FIG. 5 has a cylinder roll 31, which is provided on the circumferential edge with semicircular recesses 32, which are frontally bounded. As in the construction according to FIG. 3, there are also two feed rolls 15 for in each case one film 16, as well as a welding device 17. Cylinder roll 31 is positioned below chute 27 of the vortex chamber 1 (FIG. 4). A film web 16 is placed in the recess 32 in the jacket of cylinder roll 31. The corresponding recess 32 with inserted film 16 is then passed under chute 27, this preferably taking place with the same timing as the vortexing of individual portion in vortex chamber 1. A tangled fibrous material portion vortexed in vortex chamber 1 slides into the corresponding recess 32. During the following further conveying, a further film 16 is placed over the tangled fibrous material in the recess 32 and is welded to the first-inserted film by a welding device 17 at jacket points of the cylinder roll between two recesses 32, so that individual portion packs or bags 21 are formed.

What is claimed is:

1. Product for producing fiber-reinforced thermal plastic parts, the product comprising a wadding-like felt including individual fibers substantially completely individualized, the individual fibers assuming an irregular arrangement and distribution, a binder with a primary base adhering to laminated individual fibers, and vacuum packaging means for accommodating the laminated individual fibers.

2. A product for producing fiber-reinforced thermal plastic parts, the product comprising a wadding-like felt including individual fibers, substantially completely individualized, the individual fibers assuming an irregular arrangement and distribution, a binder with a primary base adhering to laminated individual fibers, and wherein the laminated individual fibers are compressed to form stable molded bodies as an intermediate product.

3. A product according to claim 2, wherein the intermediate products are subjected to a heat treatment so as to melt a surface thereof and are yieldable when cooled.

4. A process for producing a random fiber polymer mixture of cut glass fiber bundles and a polymer mixture as a starting product for a production of glass fiber-reinforced molded plastic parts, the process comprising the steps of:

mixing at least one of grit thermoplastic material and additives into the random fiber polymer mixture in a heating and cooling mixture;

adding the glass fiber bundles to a vortexing chamber means;

vortexing the glass fiber bundles in a turbulent air stream in the vortexing chamber means until individual filaments are produced;

adding the polymer mixture to the vortexing chamber means no later than during vortexing; and packing the random fiber polymer mixture from the vortexing chamber means in packs under a vacuum.

5. Process according to claim 1, wherein the glass fibre bundles are filamented from both ends thereof.

6. Process according to claim 1, further comprising simultaneously supplying the glass fiber bundle and polymer mixture during the step of vortexing.

7. Process according to claim 1, wherein the step of adding the polymer mixture includes feeding the polymer mixture into an air flow together with the glass fiber bundles.

8. Process according to claim 1, wherein the step of adding the polymer mixture and the glass fiber bundles includes feeding the same into a compressed air flow and deflecting the glass fibre-laden air into a turbulent eddy flow of varying direction.

9. Process according to claim 1, comprising the step of discontinuously batchwise vortexing the glass fiber bundles and polymer mixture.

10. Process according to claim 9, wherein the glass fibre bundles and binder are directly fed into a vortex chamber and subsequently vortexed with compressed air.

11. Process according to claim 1, wherein the glass fibre bundles and binder are exposed to speed changes in a turbulent eddy flow.

12. Process according to claim 1, wherein the step of adding the polymer mixture includes supplying pulverulent binder with an angular rough surface configuration.

13. Process according to claim 1, further comprising the step of electrostatistically charging the components during vortexing.

14. A process according to claim 1, further comprising the step of compressing the random filter polymer mixture to a felt-like structure following a formation thereof.

15. An apparatus for for manufacturing a random fiber polymer mixture from cut glass fiber bundles and a polymer mixture as a starting product for manufacturing fiber reinforced plastic parts, the apparatus comprising:

heating and cooling mixture means for mixing powdered or at most grit thermal plastic as well as additives to the polymer mixture;

a vortexing chamber means for receiving the fiber bundles and for vortexing the fiber bundles in a turbulent air flow to produce individual filaments;

a compressed air line means for for feeding an air stream into the vortexing chamber means;

at least one feed means for feeding the last fiber bundles and the polymer mixture into the vortexing chamber means, with the polymer mixture being introduced into the vortexing chamber means no later than during a vortexing of the fiber bundles; and a packing means for packing the random fiber polymer mixture from the vortexing chamber means in packages under a vacuum.

16. Apparatus according to claim 15, further comprising a means for venting the vortexing chamber means.

17. Apparatus according to one of claims 15 or 16 wherein the compressed air line means includes a mouthpiece means extending into the vortexing chamber means, and means for mounting the mouthpiece means so as to be movable in varying directions with respect to the vortexing chamber means.

18. Apparatus according to claim 17, wherein the vortexing chamber means includes a container with a discharge opening extending over a cross-section of the vortexing chamber means.

19. Apparatus according to claim 15, wherein the at least one feed means issues into the compressed air line means.

20. Apparatus according to claim 17, a discharge gate inserted into the container from a side opposite to the discharge opening and movable up to the latter.

21. Apparatus according to claim 15, wherein the feed means issues into the vortexing chamber means at a distance from an opening of the compressed air line means.

22. Apparatus according to claim 16, wherein the vortexing chamber includes a horizontal cylinder having a jacket, the compressed air line means communicate with the jacket, and wherein the discharge opening is constructed in the jacket, and a closeable pivotable discharge gate following the jacket contour is provided.

23. Apparatus according to claim 22, characterized in that a chute is connected to said discharge opening.

24. Apparatus according to claim 15 wherein the means for packing the random fiber polymer mixture includes a film supplying means disposed downstream of a discharge opening of the apparatus whereby the random fiber polymer mixture is packed in film packs.

25. Apparatus according to claim 13, characterized in that behind the discharge opening is connected a device for packing glass fibre felt in film packs.

26. A process of manufacturing a random fiber polymer mixture from cut fiber bundles and a polymer mixture as a starting product for manufacturing fiber-reinforced molded parts, the method comprising the steps of:

adding at least one of a powdered and grit thermal plastic as well as additives to the polymer mixture in a heating and cooling mixture;

adding the fiber bundles to a vortexing chamber;

vortexing the fibers in the vortexing chamber and converting the filaments in a turbulent air stream in the vortexing chamber means until individual filaments are produced;

adding the polymer mixture to the vortexing chamber no later than during the vortexing of the fibers; and compressing the random fiber polymer mixture following a discharge from the vortexing chamber means.

27. A process according to claim 26 wherein the glass fiber bundles are filamented from both ends thereof.

28. A process according to claim 26, further comprising simultaneously supplying the glass fiber bundle and polymer mixture during the step of vortexing.

29. A process according to claim 26, wherein the step of adding the polymer mixture includes feeding the polymer mixture into an air flow together with the glass fiber bundles.

30. A process according to claim 26, wherein the step of adding the polymer mixture and glass fiber bundles includes feeding the same into a compressed air flow and deflecting the glass fiber-latent air into a turbulent eddy flow of varying direction.

31. A process according to claim 26, further comprising the step of discontinuously batchwise vortexing the glass fiber bundles and polymer mixture.

32. A process according to claim 26, wherein the glass fiber bundles and polymer mixture are directly fed into a vortexing chamber and subsequently vortexed with compressed air.

33. A process according to claim 26, wherein the glass fiber bundles and polymer mixture are exposed to speed changes in a turbulent eddy flow.

34. A process according to claim 26, wherein the step of adding the polymer mixture includes supplying pulverulent binder with an angular rough surface configuration.

35. A process according to claim 26, further comprising the step of electrostatically charging the compounds during vortexing.

36. A process according to claim 26, further comprising the step of compressing the random fiber polymer mixture into a felt-like structure following a formation thereof.

37. An apparatus for manufacturing a random fiber polymer mixture from cut fiber bundles and a polymer mixture as a starting point for making fiber-reinforced plastic parts, the apparatus comprising:

a heating and cooling mixer means for mixing powdered or at most grit thermal plastic as well as additives to the polymer mixture;

a vortexing chamber means for receiving the fiber bundles and vortexing the fiber bundles in a turbulent air flow until individual filaments are produced;

compressed air line means for feeding the air flow to the vortexing chamber means;

at least one feeding means for feeding the fiber bundles and the polymer mixture into the vortexing chamber means, the polymer mixture being introduced into the vortexing chamber means no later than during a vortexing of the fiber bundles; and compressing means for compressing the random fiber polymer mixture into a compact self-supporting semi-finished product.

38. An apparatus according to claim 37, further comprising means for venting the vortexing chamber means.

39. An apparatus according to one of claims 37 or 38 for in the compressed air line means includes a mouthpiece means extending into the vortexing chamber means, and means for mounting the mouthpiece means so as to be movable in varying directions with respect to the vortexing chamber means.

40. An apparatus according to claim 37, wherein the vortexing chamber means includes a container means with a discharge opening extending over a cross-section of the vortexing chamber means.

41. An apparatus according to claim 37, wherein the at least one feeding mechanism issues into the compressed air line means.

42. An apparatus according to claim 40, further comprising a discharge gate inserted into the container means from a side thereof opposite to the discharge opening and movable up to the latter.

43. An apparatus according to claim 37, wherein the at least one feeding means issues into the vortexing chamber means at a distance from an opening of the compressed air line means.

44. An apparatus according to claim 40, wherein the vortexing chamber means includes a horizontal cylinder having a jacket, the compressed air line means and feed means communicate with the jacket, and wherein the discharge opening is constructed in the jacket and is closeable by a pivotable discharge gate following a contour of the jacket.

45. An apparatus according to claim 40, wherein the compression means for compressing the random fiber polymer mixture into a compact self-supporting semi-finished product includes a discharge gate and a counter pressure plate arranged at a distance from the discharge opening.

46. An apparatus according to claim 40, further comprising a means for packing the random fiber polymer mixture including a film supplying means disposed downstream of the discharge opening of the apparatus whereby the random fiber polymer mixture is packed in film packs.

* * * * *